US006990930B2

(12) United States Patent
Sarkar

(10) Patent No.: US 6,990,930 B2
(45) Date of Patent: Jan. 31, 2006

(54) STEAM GENERATION APPARATUS AND METHOD

(75) Inventor: Sujit K. Sarkar, Calgary (CA)

(73) Assignee: ACS Engineering Technologies Inc., Calgary (CA)

( * ) Notice: Subject to any disclaimer, the term of this patent is extended or adjusted under 35 U.S.C. 154(b) by 0 days.

(21) Appl. No.: 10/709,676

(22) Filed: May 21, 2004

(65) Prior Publication Data

US 2004/0261729 A1 Dec. 30, 2004

(51) Int. Cl.
*F22B 1/16* (2006.01)

(52) U.S. Cl. ..... 122/7 R; 122/1 C; 122/149; 122/33

(58) Field of Classification Search ..... 122/1 C, 122/7 R, 33, 149, 150, 25, 236, 414, 422, 122/459, 235.13
See application file for complete search history.

(56) References Cited

U.S. PATENT DOCUMENTS

| | | | | |
|---|---|---|---|---|
| 75,296 | A | 3/1868 | Quinn | |
| 135,996 | A | 2/1873 | McMahon | |
| 301,092 | A | 7/1884 | Carvalho | |
| 355,178 | A | 12/1886 | Kirby | |
| 451,245 | A | 4/1891 | Hyde | |
| 603,502 | A | 5/1898 | Fox | |
| 715,842 | A | 12/1902 | McKay | |
| 722,466 | A | 3/1903 | Sutton | |
| 931,907 | A | 8/1909 | Wegener | |
| 1,150,948 | A | 8/1915 | Laziny | |
| 1,421,902 | A | 7/1922 | Brown | |
| 1,775,962 | A | 9/1930 | Love | |
| 1,980,424 | A | 11/1934 | Morgan | |
| 2,020,686 | A | 11/1935 | Kaiser | |
| 2,207,654 | A | 7/1940 | Brown | |
| 2,291,872 | A | 8/1942 | Brantly | |
| 2,304,409 | A | 12/1942 | Jeffords | |
| 2,312,622 | A | 3/1943 | Brantly | |
| 2,685,866 | A | 8/1954 | Yost | |
| 3,017,870 | A | 1/1962 | Profos | |
| 3,052,223 | A | 9/1962 | Profos | |
| 3,267,912 | A | 8/1966 | Läubli | |
| 3,357,407 | A | 12/1967 | Fanaritis | |
| 4,008,041 | A | 2/1977 | Roffe et al. | |
| 4,101,265 | A * | 7/1978 | Broach et al. | 432/29 |
| 4,109,613 | A | 8/1978 | Hayden et al. | |

(Continued)

OTHER PUBLICATIONS

Portion of CA 1,273,856; Published Sep. 11, 1990; Zorzit.

(Continued)

*Primary Examiner*—Gregory Wilson
(74) *Attorney, Agent, or Firm*—Bennett Jones LLP

(57) ABSTRACT

In one aspect, the invention provides a steam generation apparatus that is liquid fuel fired and addresses conversion of gaseous fuel SIB units to operate with liquid fuel. The invention also relates to a conversion unit for a steam injection boiler, a method for converting a steam injection boiler from gas firing to possible liquid fuel firing and a method for generating steam from a liquid fuel source. The invention employs a fired heater for heating the liquid fuel to a temperature suitable for firing and preheats the water to compensate for the shortfall in heat liberation when a gas boiler is converted to use liquid fuel. In another aspect of the invention, production of steam is achievable consistently by employing step-up heaters with a steam injection boiler. The heaters being connected in parallel to continue heating the water/steam to achieve a higher quality steam over that produced in the boiler while minimizing consideration as to the adverse effects of coil fouling in the boiler.

35 Claims, 6 Drawing Sheets

U.S. PATENT DOCUMENTS

| | | | | |
|---|---|---|---|---|
| 4,109,614 | A * | 8/1978 | Viessmann | 122/149 |
| 4,140,472 | A | 2/1979 | Hoehing et al. | |
| 4,140,473 | A | 2/1979 | Hoehing et al. | |
| 4,289,475 | A | 9/1981 | Wall et al. | |
| 4,302,177 | A | 11/1981 | Fankhanel et al. | |
| 4,429,661 | A * | 2/1984 | McClure | 122/20 B |
| 5,293,842 | A | 3/1994 | Loesel | |
| 5,979,549 | A | 11/1999 | Meeks | |
| 6,129,148 | A | 10/2000 | Meeks | |
| 6,190,628 | B1 | 2/2001 | Carter | |
| 6,210,150 | B1 | 4/2001 | Rosen et al. | |
| 6,475,409 | B2 | 11/2002 | Iijima et al. | |
| 6,481,207 | B2 | 11/2002 | Miura et al. | |
| 6,481,641 | B1 | 11/2002 | Mieney | |
| 6,523,348 | B1 | 2/2003 | Acharya et al. | |
| 2002/0002819 | A1 | 1/2002 | Gorman et al. | |
| 2002/0017100 | A1 | 2/2002 | Berndt et al. | |
| 2002/0152681 | A1 | 10/2002 | Oh et al. | |
| 2002/0157618 | A1 | 10/2002 | Franke et al. | |
| 2003/0000220 | A1 | 1/2003 | Liebig et al. | |
| 2003/0015321 | A1 | 1/2003 | Lim et al. | |
| 2003/0017428 | A1 | 1/2003 | Reiner et al. | |
| 2003/0024488 | A1 | 2/2003 | Bingham et al. | |
| 2003/0035766 | A1 | 2/2003 | Baca et al. | |
| 2003/0037534 | A1 | 2/2003 | Sugishita et al. | |

OTHER PUBLICATIONS

Portion of CA 1,128,386; Published Jul. 27, 1982; Viessmann.
Portion of CA 1,252,352; Published Apr. 11, 1989; Krans, et al.
Portion of CA 2,024,816; Published Apr. 18, 1991; Albrecht.
Portion of CA 1,123,287; Published May 11, 1982; Livingstone.
Portion of CA 1,166,532; Published May 1, 1984; Styslinger.
Portion of CA 2,082,502; Published Oct. 29, 1992; Balint, et al.
Portion of CA 2,089,612; Published Apr. 17, 1994; Moscone.
Portion of CA 2,314,844; Published Feb. 2, 2001; Tanaka, et al.
Portion of CA 1,259,537; Published Sep. 19, 1989; Buice.
Portion of CA 2,211,983; Published Aug. 28, 1998; Watanabe, et al.
Portion of CA 2,094,205; Published Oct. 18, 1993; Nagato, et al.
Portion of CA 1,099,161; Published Apr. 14, 1981; Jehn, et al.
Portion of CA 1,080,053; Published Jun. 24, 1980; Michel.
Portion of CA 2,157,221; Published Mar. 9, 1996; Phelps.
Portion of CA 1,170,175; Published Jul. 3, 1984; Sperry, et al.
Portion of CA 1,260,341; Published Sep. 26, 1989; Paquet.
Portion of CA 1,201,026; Published Feb. 25, 1986; Rees.
Portion of CA 1,129,276; Published Aug. 10, 1982; Angelini.
Portion of CA 2,049,815; Published Feb. 28, 1992; Budin, et al.
Portion of CA 1,156,886; Published Nov. 15, 1983; Beckett.
Portion of CA 1,050,839; Published Mar. 20, 1979; Woodmansee, et al.
Portion of CA 653,200; Published Nov. 27, 1962; Alick, et al.
Portion of CA 2,006,576; Published Jun. 22, 1990; Miura, et al.
Portion of CA 1,313,088; Published Jan. 26, 1993; Campbell, et al.
Portion of CA 1,318,196; Published May 25, 1993; Abdulally.
Portion of CA 1,329,323; Published May 10, 1994; Ziemianek.
Portion of CA 2,058,161; Published Jun. 22, 1992; Hulkkonen, et al.
Portion of CA 2,060,375; Published Aug. 1, 1992; Soltys, et al.
Portion of CA 2,102,835; Published May 14, 1994; Dietz.
Portion of CA 2,124,432; Published Jan. 7, 1995; Tang.
Portion of CA 2,163,172; Published Jun. 8, 1996; Campbell, et al.
Portion of CA 2,186,369; Published Oct. 19, 1995; Hiltunen, et al.
Portion of CA 2,239,391; Published Jul. 2, 1998; Garcia-Mallol.
Portion of CA 2,383,586; Published Mar. 8, 2001; Worman.
Portion of CA 525,170; Published May 15, 1956; Alick.
Portion of CA 561,863; Published Aug. 12, 1958; Alick.
Portion of CA 788,269; Published Jun. 25, 1968; Fanaritis.
Portion of CA 1,196,344; Published Nov. 5, 1985; McCallister.
Portion of CA 1,261,630; Published Sep. 26, 1989; Spangler, et al.
Portion of CA 2,096,011; Published May 28, 1992; Corbett, et al.
Portion of CA 2,026,455; Published Apr. 4, 1991; Tokuda, et al.
Portion of CA 1,133,773; Published Oct. 19, 1982; Bernstein.
Portion of CA 1,163,919; Published Mar. 20, 1984; Meeks, et al.
Portion of CA 2,372,547; Published Nov. 9, 2000; Hagan, et al.
Portion of CA 1,215,230; Published Dec. 16, 1986; Osman.
Portion of CA 1,285,899; Published Jul. 9, 1991; Fuderer.
Portion of CA 2,389,444; Published Jan. 18, 2003; Cargel, et al.
Portion of CA 1,235,610; Published Apr. 26, 1988; Downs, et al.
Portion of CA 2,105,166; Published Oct. 1, 1992; Valentine.
Portion of CA 2,373,456; Published Oct. 26, 2002; Tsirutnikov, et al.
Portion of CA 2,394,202; Published Jun. 21, 2001; Henkel, et al.
Portion of CA 1,166,531; Published May 1, 1984; Rodwell.
Portion of CA 315,507; Published Sep. 22,1931; Barnes.
Portion of CA 325,131; Published Aug. 16, 1932; Lucke.
Portion of CA 325,287; Published Aug. 23, 1932; Lucke.
Portion of CA 326,507; Published Oct. 4, 1932; Jones.
Portion of CA 342,249; Published Jun. 12, 1934; Jacobus, et al.
Portion of CA 345,165; Published Oct. 9, 1934; Howard, et al.
Portion of CA 355,745; Published Feb. 4,1936; Schmidt.
Portion of CA 505,241; Published Aug. 17, 1954; Clarkson.
Portion of CA 611,339; Published Dec. 27, 1960; Theodore.
Portion of CA 840,746; Published May 5, 1970; Vorkauf.
Portion of CA 893,491; Published Feb. 22, 1972; Ruhe.
Portion of CA 1,041,079; Published Oct. 24, 1978; Hapgood.
Portion of CA 1,041,080; Published Oct. 24, 1978; Hapgood.

Portion of CA 1,041,081; Published Oct. 24, 1978; Hapgood.
Portion of CA 1,042,291; Published Nov. 14, 1978; Gibson.
Portion of CA 1,062,976; Published Sep. 25, 1979; Viessmann.
Portion of CA 1,088,823; Published Nov. 4, 1980; Regamey.
Portion of CA 1,091,108; Published Dec. 9, 1980; Siegrist.
Portion of CA 1,095,347; Published Feb. 10, 1981; Freund.
Portion of CA 1,125,115; Published Jun. 8,1982; Shenker.
Portion of CA 1,238,539; Published Jun. 28, 1988; Dragojevic.
Portion of CA 1,067,484; Published Dec. 4, 1979; Smith.
Portion of CA 1,127,143; Published Jul. 6, 1982; Kubo, et al.
Portion of CA 1,268,999; Published May 15, 1990; Elmlund.
Portion of CA 1,265,713; Published Feb. 13, 1990; Cooke.
Portion of CA 2,094,882; Published Oct. 29, 1993; Pascal.
Portion of CA 2,187,201; Published Apr. 25, 1996; Rice.
Portion of CA 1,170,174; Published Jul. 3, 1984; Fox.
Portion of CA 2,033,988; Published Dec. 27, 1990; Fulleman.
Design aspects of once through systems for heat recovery steam generators for base load and cyclic operation; Brady; Materials at High Temperatures 18(4) 223-229 © 2001 Science Reviews.

* cited by examiner

STEAM GENERATION APPARATUS AND METHOD

BACKGROUND OF INVENTION

The present invention relates to steam generation apparatus and, in particular, steam generation apparatus for secondary recovery of oil, a conversion unit for steam generation apparatus and methods for steam generation and conversion of steam generation apparatus.

Steam is often used in industrial processes. For example, steam can be used for heat exchange, as a power source for driving turbines, etc.

In the petroleum industry, for example, steam can be used for extraction processes and to enhance production. In one procedure, steam may be used for the recovery of bitumen or heavy oil from oil-bearing formations. A common process utilized for the in situ recovery of heavy oil or bitumen is to inject steam underground pursuant to which the viscosity of bitumen or heavy oil is decreased such that it flows and is capable of being pumped to the surface. For this, steam generation equipment commonly called steam injection boilers ("SIB") are used to generate steam of the required/desired quality.

For in situ recovery of bitumen or heavy oil, prominent processes utilized are steam assisted gravity drainage ("SAGD") and cyclic steam stimulation, with the SAGD process gaining in popularity due to it capabilities for enhanced recovery of bitumen or heavy oil. Generally, high quality steam of greater than 70% (i.e. 70% steam and 30% water) is generated by the boiler in specified volumes per hour depending on output capabilities of the boiler, as well as steam output requirements for the recovery and extraction process. Some processes generate/require 100's of thousands/lbs steam per hour. An 80% quality steam may commonly be used. Producing very high quality steam of greater than 80% quality typically results in escalating cost due to water treatment costs, potentially rendering a project uneconomical. Conversely, lower than 80% quality steam introduces inefficiencies to the process utilized for heavy oil or bitumen recovery and, hence, is also undesirable from a cost perspective.

Current SIB unit designs generally include horizontal cylindrical units including a combustion chamber with a burner at one end and steam generating coils therein, such as helical or serpentine steam generating coils, etc. Since almost all SIB units are fired with gaseous fuel (i.e. natural gas or liquid petroleum gas), these units are designed to suit the firing of this gaseous fuel.

Unfortunately, however, the gaseous fuel must often be piped significant distances to the location of steam generation, resulting in a significant cost to the producer due to the price of the gaseous fuel and the cost of the associated pipeline construction and maintenance. In fact, it has been stated that the economics associated with the in situ recovery of bitumen or heavy oil are primarily driven by the price of the gaseous fuel required to generate steam.

Thus, there is a desire in the industry to move to lower cost and/or more accessible fuels. The logical choice would be to fuel the steam generator using a small portion of the heavy oil or bitumen being produced at the site. However, conversion of SIB units from gas fuel to liquid fuel, such as heavy oil or bitumen, has been problematic for a number of reasons.

For example, since the flame resulting from firing natural gas is generally shorter than the flame resulting from firing liquid fuel, such as bitumen or heavy oil, the conversion of an existing SIB unit from gas firing to liquid fuel firing inevitably leads to lower firing rates as the combustion chamber of an existing SIB unit is only designed and sized to accommodate operating conditions incidental to gas firing. While lower firing rates of bitumen can be used and adjusted to mimic the gaseous fuel flame envelope size restrictions of the existing combustion chamber, these lower firing rates result in lower steam generating capacity, as well as lower quality steam (i.e. less than 80% quality). Combusting bitumen or heavy oil also requires the utilization of emission reduction/abatement technologies and equipment, as these liquids generally contain sulfur and other metallic components, resulting in undesirable by-products when combusted.

Even in new installations, the problems associated with liquid fuel firing has driven the industry to continue to use gaseous fuels. For example, a much larger combustion chamber is required for an oil-fired boiler to produce steam of the required quality and in the required amounts. This results in extra costs for equipment, transport and installation.

SUMMARY OF INVENTION

The invention provides a steam generation apparatus that is liquid fuel fired either newly constructed or through conversion of gaseous fuel SIB units to operate with liquid fuel. The invention also relates to a conversion unit for a steam injection boiler, a method for converting a steam injection boiler from gas firing to possible liquid fuel firing and a method for generating steam from a liquid fuel source.

In accordance with a broad aspect of the present invention, there is provided a steam generation apparatus comprising: a fired steam injection boiler including a burner open thereto; a fired heater including a heater burner open thereto; a water tube circuit extending through the heater combustion chamber and through the steam injection boiler combustion chamber, the water tube circuit selected to convey water in order to heat the water to generate steam; a fuel tube extending through the heater combustion chamber selected to convey liquid fuel in order to heat the liquid fuel to a temperature suitable for firing and thereafter conveying the heated liquid fuel to support the firing of the steam injection boiler and the fired heater.

In accordance with another broad aspect of the present invention, there is provided a steam injection boiler conversion unit for converting a steam injection boiler from gaseous fuel firing to be capable of liquid fuel firing, the steam injection boiler including a burner operable therein and a boiler tube circuit extending therethrough, the steam injection boiler conversion unit comprising: a fired heater including a heater burner; a fired heater tube extending through the heater combustion chamber, the fired heater tube circuit selected to convey water in order to heat the water and the fired heater tube circuit being connectable into fluid flow communication with the boiler tube circuit such that, when connected, water passes through both the fired heater tube and the boiler tube circuit for the generation of steam; a fuel tube extending through the heater combustion chamber, the fuel tube selected to convey liquid fuel in order to generate heated liquid fuel; and a conduit connectable into fluid flow communication with the burner of the boiler for supplying the heated liquid fuel to support the firing of the boiler burner, when the conduit is connected to the boiler burner.

The fired heater may serve, for example, to: (i) heat the liquid fuel to the temperature required for firing; and (ii) heat the water/steam, such that the heat available from liquid fuel firing in the steam injection boiler is adequate to meet both steam throughput and steam quality requirements upon outlet from the steam generation apparatus. The combustion in the fired heater can be controlled to control steam quality and throughput. This control can be achieved by adjustment of the firing rate of the fired heater.

The liquid fuel can include, for example, bitumen or heavy oil. Of course other fuels such as medium oil, light oil, etc. could be used. However, the lower grade fuels may be relatively more economical and more readily available (i.e. on site at an in situ operation where steam generation is required).

To handle liquid fuel, the boiler gas burner may be replaced with a burner capable of handling liquid fuel, for example, including an atomizer and an inlet for an atomizing steam supply.

The fired heater can be fired by any desired fuel. However, it is advantageous for the fired heater also to be fired by liquid fuel. Thus, in one embodiment, a conduit can be provided for conveying the heated liquid fuel to support the firing of the heater burner and the heater burner is adapted for burning liquid fuel and, for example, includes an atomizer and an inlet for a steam supply. In such an embodiment, a connection to an alternate fuel supply may be provided to permit operation of the fired heater by means of that alternate fuel source, such as a gaseous fuel including, for example, propane, liquid petroleum gas or natural gas. This may be particularly useful during initial start up of the steam generation apparatus or the converted steam injection boiler, since there may be no liquid fuel yet produced or the liquid fuel may not be in a heated condition ready for use as a fuel in either the boiler burner or the heater burner.

The fired steam injection boiler and the fired heater each exhaust combustion gases from their combustion chambers. Combustion of some liquid fuels can generate unfavorable by-products, and it is desirable to maintain the net undesirable emissions arising from the combustion of liquid fuel to a level not greater than the emissions arising from the combustion of any currently used fuel, such as natural gas. Thus, in one embodiment, the exhausted combustion gases may be scrubbed to reduce emissions of unfavorable by-products such as nitrogen oxides (NOx) and sulfur oxides (SOx). Various exhaust arrangements may be used including an exhaust from both the combustion chamber of the heater and the combustion chamber of the boiler, each with their own scrubbing arrangement. In another embodiment, the exhaust of the fired steam injection boiler and the exhaust of the fired heater are connected to share a scrubbing device. In yet another embodiment, an exhaust arrangement can be provided that includes a scrubbing device but includes a means for controlling the outlet of combustion gases such combustion gases are passed through the scrubbing device. This can be achieved, for example, by use of a damper-controlled bypass.

In accordance with another broad aspect of the present invention, there is provided a method for converting a steam injection boiler from gaseous fuel firing to be capable of liquid fuel firing, the steam injection boiler including a combustion chamber with a burner open thereto and a boiler tube extending therethrough, the method for converting comprising: providing a fired heater including a heater combustion chamber, a heater burner, a fired heater tube extending through the heater combustion chamber, the fired heater tube selected to convey water in order to heat the water and a fuel tube extending through the heater combustion chamber, the fuel tube selected to convey liquid fuel in order to generate heated liquid fuel; bringing the fired heater tube in fluid flow communication with the boiler tube such that fluid passing from the fired heater tube can pass into the boiler tube; and conveying the heated liquid fuel to the burner of the boiler to support the firing of the steam injection boiler.

In one embodiment, the exhaust systems for outlet of combustion gases from the steam injection boiler is modified to address emissions. For example, the method may include fitting the exhaust system with a scrubber device.

In accordance with another broad aspect of the present invention, there is provided a method for generating steam, the method comprising: providing a steam generation apparatus including a fired steam injection boiler including a combustion chamber with a burner open thereto; a fired heater including a heater combustion chamber and a heater burner; a water tube extending through the heater combustion chamber and thereafter through the steam injection boiler combustion chamber, the water tube selected to convey water in order to heat the water to generate steam; a fuel tube extending through the heater combustion chamber selected to convey liquid fuel in order to generate heated liquid fuel; and a conduit for conveying the heated liquid fuel to support the firing of the steam injection boiler; firing the fired heater to heat a supply of liquid fuel passing through the fuel tube; conveying the liquid fuel through the conduit to support firing of the steam injection boiler; passing a flow of water through the water tube such that steam is generated.

The liquid fuel can be taken from in situ production. It may be advantageous to use the liquid fuel while it retains latent heat from production so that it has a viscosity that facilitates handling.

In accordance with another broad aspect of the present invention there is provided a steam generation apparatus comprising: a steam injection boiler including a combustion chamber and a water tube circuit extending through the steam injection boiler combustion chamber, the water tube circuit selected to convey water in order to heat the water to generate steam; a first step-up heater and; a second step up heater, the first and second step up heaters being operable at conditions to heat the water in association the boiler to a level wherein fouling of water solids occurs in the heaters preferentially over fouling occurring in the boiler and the first and second step up heaters being operable in parallel such that one step up heater can be operated while the other step up heater is offline.

In accordance with another broad aspect, there is provided a steam generation apparatus comprising: a steam injection boiler including a burner operable therein and a boiler water coil extending through the steam injection boiler and including an outlet the boiler water coil selected to convey water in order to heat the water to generate steam; at least a first heater and a second heater, each including a steam heating circuit, the steam heating circuits being connected in parallel with each other and in fluid flow communication with the boiler water coil and the heater selected to increase the steam quality of the steam passing from the steam injection boiler; and a flow controller to control flow through the first and the second heaters and actuable to select that flow is permitted through only a selected one of the first heater steam heating circuit and the second heater steam heating circuit.

In accordance with another broad aspect of the present invention, there is provided a method for a method for generating steam, the method comprising: providing a steam generation apparatus including a fired steam injection boiler including a combustion chamber and a water tube extending through the steam injection boiler combustion chamber; providing a first step-up heater and a second step up heater; operating the boiler to convey water through the water tube to heat the water to generate steam; operating the first and the second step up heaters at conditions to heat the water in association with the boiler to a level wherein fouling of water solids occurs in the heaters preferentially over fouling occurring in the boiler; and shutting down the first step up heater to defoul it while the second step-up heater remains operating to heat the water in association with the boiler.

In accordance with yet another broad aspect of the present invention, there is provided a method for generating steam comprising: providing a steam injection boiler including a burner operable therein and a boiler water coil extending through the steam injection boiler and including an outlet the boiler water coil selected to convey water in order to heat the water to generate steam; at least a first heaters and a second heater, each including a steam heating circuit, the steam heating circuits being connected in parallel with each other and in fluid flow communication with the boiler water coil and selected to increase the steam quality of the steam passing from the steam injection boiler; and a flow controller to control flow through the first and the second heaters and actuable to select that flow is permitted through only a selected one of the first heater steam heating circuit and the second heater steam heating circuit; conveying water through the boiler water coil and through the steam heating circuit of a selected one of the first heater or the second heater to generate steam from the water; defouling the steam heating circuit of the other of the first heater or the second heater; and switching flow to the other of the first heater or the second heater when the steam heating circuit of the selected heater when it is desired to defoul the selected steam heating circuit.

BRIEF DESCRIPTION OF DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION

Figure 1:
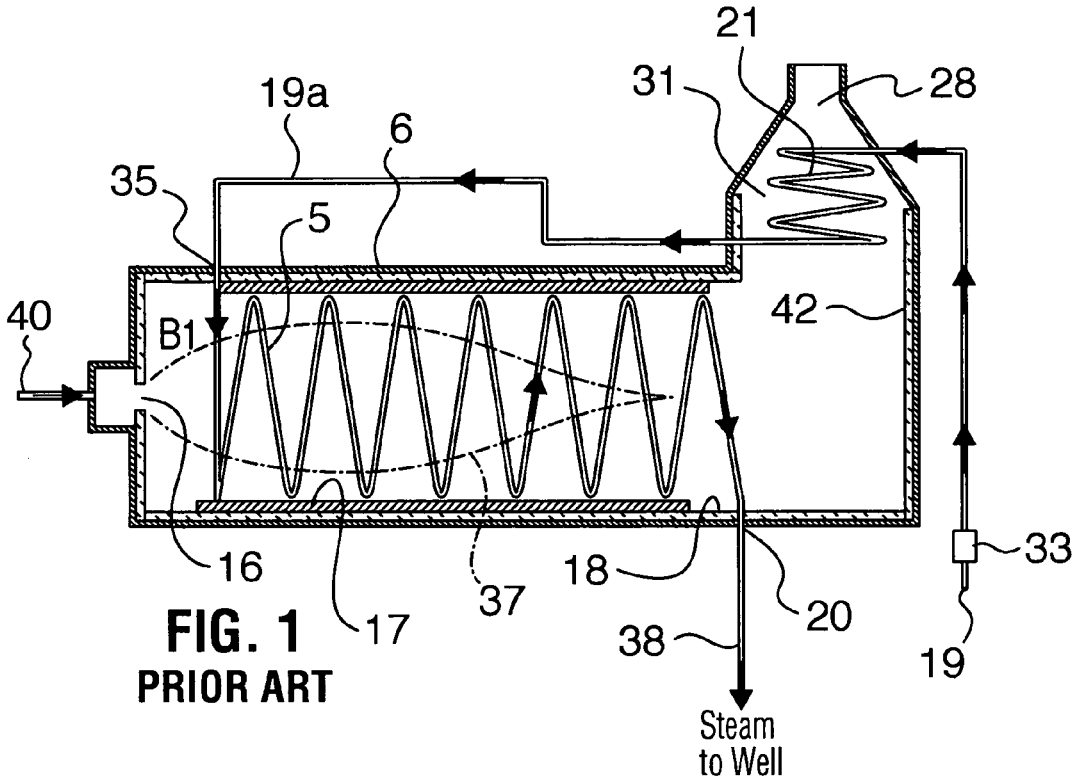
FIG. 1 PRIOR ART
FIG. 1 is a schematic drawing of a prior art steam injection boiler.

Referring to FIG. 1, a prior art steam injection boiler B1 is shown. Similar steam injection boilers are alternately termed "steam flood boilers", "water flood boilers" or "once through steam generators". Some of the leading manufacturers include Struthers Industries Inc., Gulfport, Miss., HTH Heatech Inc., Calgary, Alberta and Applied Thermal Systems (ATS) Inc., Tulsa, Okla.

The steam injection boiler includes a combustion chamber defined by an outer wall 6. Combustion chamber includes a burner 16 for handling gaseous fuel such as liquid petroleum gas or natural gas supplied through line 40. Burner 16, when in operation, creates, a flame shown in phantom as 37, and combustion chamber thereby includes a radiant zone, a convection zone 31 and an exhaust stack 28. The outer wall has a refractory lining 18.

A feed water line 19 feeds water by use of a feed pump 33 to coils in the boiler for the generation of steam from the water. In particular, feed water line 19 leads first to a preheat coil 21 disposed in the convection zone. Preheat coil then feeds through a line 19*a* to inlet 35 and steam coils 5 in the radiant zone. Coils 21 and 5 are supported within the boiler on supports 17 such that they are disposed, for example, in a helical or serpentine arrangement.

A line 38 leads from steam outlet 20 to feed the steam generated in boiler B1 to the well.

When in operation, burner 16 is fired by gaseous fuel through line 40 to generate flame 37 within the combustion chamber. Combustion gases exit the chamber by passing through convection zone 31 and exhaust stack 28. Water, which is under pressure and may be treated to adjust its mineral content, is fed through line 19 to preheat coils wherein the water temperature is increased by heat exchange with the combustion gases. The preheated water is then conveyed via line 19*a* to coils 5 in the radiant zone of the boiler. The water in the tubes is driven to its steam state while passing through the radiant zone such that when in exits at outlet 20, it is in a state ready for passing to the well to drive in situ production. Selection steam quality at outlet 20 is achieved through selection of flame 37 heat release.

Boilers such as boiler B1 are sized and configured to accommodate a flame generated by a gaseous fuel. Straight conversion of a steam injection boiler from gaseous fuel firing to liquid fuel firing with a similar BTU (British thermal unit) flame is often not feasible since the combustion chamber is not sized to accommodate the liquid fuel flame. In particular, the flames generated from gaseous fuel combustion generally have a smaller envelope/BTU than the envelope/BTU of a flame generated by use of a liquid fuel, such as bitumen or heavy oil. Thus, if seeking to convert a gaseous fuel fired combustion chamber, such as that shown in FIG. 1, to liquid fuel firing, a liquid fuel flame for equivalent BTU to a gas flame would impinge on coils 5 or end 42 and cause them to burn out. If the boiler is fired with liquid fuel at an acceptable flame envelope size, lower BTU's must be used, resulting in a reduction in heat release and, in turn, lower quality steam generation which is generally not desirable for in situ production.

Figure 2:
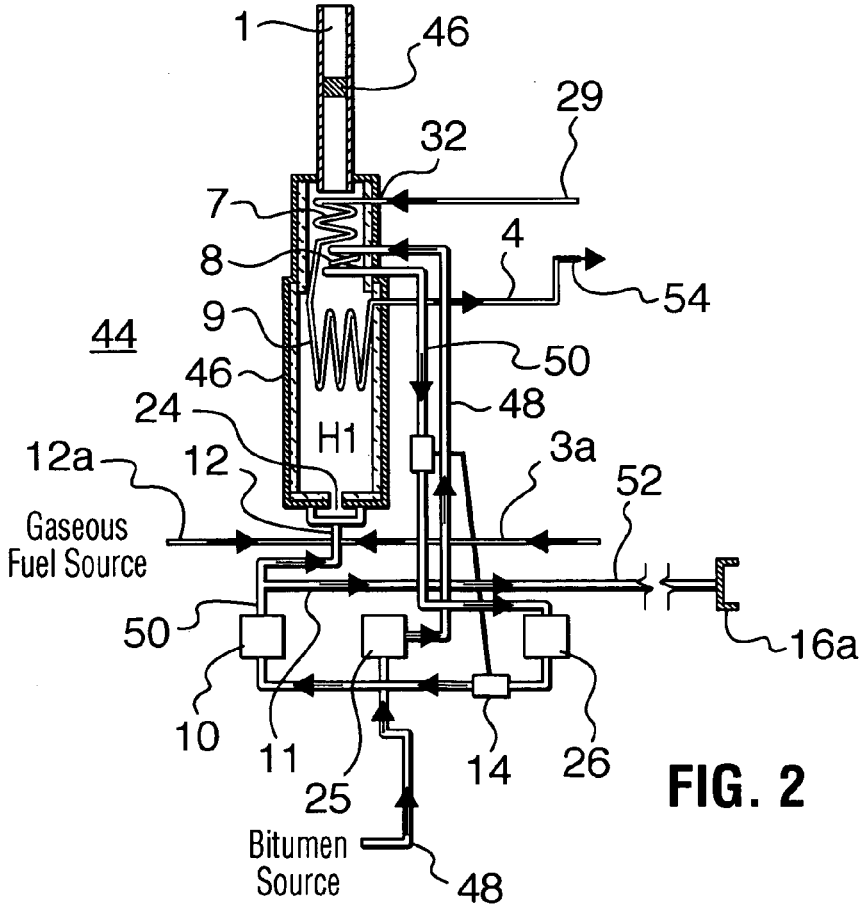
FIG. 2 is a schematic drawing of a conversion unit according to the present invention for conversion of a steam injection boiler from gas firing to liquid fuel firing capability.

Thus, referring to FIG. 2, a conversion unit 44 has been invented for fitting to a steam injection boiler such as boiler B1 of FIG. 1, so that the boiler can be used with liquid fuel. While a particular boiler configuration has been illustrated, it is to be understood that other steam injection boiler configurations are known or may be developed and those may be converted in accordance with the present invention.

Conversion unit 44 includes a fired heater H1 including a combustion chamber defined by an outer wall 46. Combustion chamber 46 includes a burner 24, which can be selected for gas-firing or, as in the illustrated embodiment, is capable of firing either gaseous or liquid fuels, or both. Such burners are available from Coen Company, Inc., Burlingame, Calif. or Hamworthy Combustion Engineering, Poole, the UK. To accommodate firing, liquid fuel may require heating and pressure atomization for effective burning. Therefore, a line 12 supplies burner with heated liquid fuel, which is atomized with steam from line 3*a*. The heated liquid fuel is supplied from a fuel handling system 10 and steam is fed from steam generation, as will be described in greater detail hereinbelow. Line 12 can also be used to supply gaseous fuel to the burner. In another embodiment, a dedicated line 12*a* for gaseous fuel supply can be provided.

Burner 24, when in operation, creates, a flame such that combustion chamber includes a radiant zone, a convection zone and an exhaust stack 1. For appropriate handling of emissions generated from the burning of fuels, a scrubber 46 can be operationally mounted in exhaust stack 1. The outer wall is lined with a refractory lining capable of withstanding gas or liquid fuel firing.

While heater has been shown in an upright configuration, other configurations, such as a horizontal configuration, are useful.

The fired heater may serve two main purposes. First, it may heat the bitumen to the temperature required for firing. The particular bitumen characteristics suitable for firing depend on factors such as the quality of the bitumen, type of burner, etc. For example, one bitumen sample, when useful for firing, was generally at about 200° C. (392° F.) and atomized with steam at generally 0.1 to 0.075 pounds of steam per 1 pound of bitumen.

The fired heater may also be used to heat the water/steam passing to or from the boiler. Such heating may offset the shortfall in heat liberation that may arise from the use of a liquid fuel flame in the boiler. For example, the fired heater can preheat the water passing to a boiler so that the boiler can be fired with a liquid fuel flame of the same or similar size to a gaseous fuel flame to suit the dimensions and configuration of the boiler. Thus, heat available from liquid fuel firing in the steam injection boiler can be adequate to meet both steam throughput and steam quality, for example to 80% quality, requirements upon outlet from the steam injection boiler.

As such to serve these purposes, fired heater H1 may have disposed through its combustion chamber water/steam coils such as coils 7 and 9 and a fuel heating coil, such as coil 8. The water in coils 7 and 9, depending on the source thereof, may be treated, heated, pressurized and/or partially converted to steam. This water is passed from a supply line 29 through inlet 32 to coil 7. Coil 7 is disposed in the convection zone of the heater and is connected to coil 9, which is disposed in the higher temperature radiant zone. Many coil configurations are possible including helical, serpentine, grid, etc. layouts, smooth, studded, finned, etc. style tubes and various materials. Consideration may be given to soot retention and cleaning issues, with respect to tube outer surfaces. Coils 7 and 9 should be selected to handle passage therethrough of hot water/steam of, for example, greater than 1500 psi and to accommodate the conditions within the combustion chamber, with respect to temperature and gases. Suitable materials are, for example, carbon steel, an alloyed metal for example chromium steel of, for example, 1¼ Chrome and ½ Molybdenum (P11) or stainless steel. Helical coil configurations, as in coil 7, may be useful where it is desired to provide for gravity drainage of the coils.

Fuel heating coil 8 is disposed in combustion chamber with consideration as to the temperature conditions and its effect on the fuel, for example, with respect to coking. In one embodiment, the fuel heating coil is mounted in the convection zone between the refractory lining and the water/steam coil 7 such that it is shielded, by coil 7, from direct radiation effects of the combustion process, to avoid coking within the coil. Many coil configurations are possible including helical, serpentine, grid, etc. layouts, smooth, studded, finned, etc. style tubes and various materials. Suitable materials may include, for example, alloyed metals, such as P11, or stainless steel.

Conversion unit 44, in addition to heater H1, may include the lines and connections for connecting the heater to a source of fuel and to a steam injection boiler. In the illustrated embodiment, a line 48 is connected to coil 8 to supply fuel to be heated to the heater. The system can include a bitumen storage tank 25, if desired, and can include heating means, if such means are needed to keep the bitumen is a flowable state. Pumps, dewatering devices and other means can be installed in line 48 to provide for liquid fuel handling and/or preparation for use as a fuel. As a back up, an auxiliary fuel heater may be installed in the system to heat the fuel in the event that heater H1 should require a shut down, such that steam can continue to be generated.

A line 50 communicates with an outlet from coil 8 and is connectable at end 52, directly or indirectly, to the burner of a steam injection boiler that is to be fitted with the conversion unit. If necessary for conversion, unit 44 can also include a liquid fuel compatible burner 16*a* obtained by reconfiguration of the original gaseous fuel burner or by replacement of the gaseous fuel burner of the steam injection boiler. In one embodiment, a dual fuel burner can be used that is capable of using both gaseous and liquid fuels. Dual fuel burners may be more useful in smaller sized boilers. For example, in many larger sized boilers, such as those capable of generating more than 50,000 pounds of steam per hour, dedicated liquid fuel burners may need to be used. Thus, if it is later desired that the boiler be returned to gaseous fuel burning, the boiler oil burner would need to be replaced with a gas burner. However, as advances in burner technology occur, dual fuel burners in larger sized boilers may become feasible.

Line 50 passes the heated fuel to the steam injection boiler and may include various means for facilitating such passage such as, for example, pumps 14, expansion tank 26 and fuel system 10 including, for example, valving, meters for temperature and pressure, heat tracing, etc. In the illustrated embodiment, where fuel is not only intended to be used in the steam injection boiler but also to be used in the heater itself, line 50 includes a connection to line 12.

Conversion unit 44 may also include a line 4 that is connectable to an outlet from coil 9 and at its end 54, directly or indirectly, to the water steam coils of the steam injection boiler that is to be fit with the conversion unit. Line 4 permits passage of preheated water to the steam injection boiler. While conversion unit 44 in the illustrated embodiment is set up to preheat water and deliver it to the inlet of a steam injection boiler, the heater could be set up to accept and heat water/steam that has already passed through the boiler, before it is passed to production. Such a water coil may assist with the production of high quality steam, as will be discussed hereinafter.

If desired, the conversion unit can include various other components for the converted boiler or to meet environmental, safety, etc. requirements. For example, with reference to FIG. 3, the conversion unit can include a scrubber 23 and soot blowers 34 for the steam injection boiler or a duct 2 for diverting exhaust from heater H1 to the steam injection boiler combustion chamber. As another example, fuel line 50 can be fit with a fire valve (not shown).

To install the conversion unit, the heater can be set up in some embodiments without affecting operation of the steam injection boiler. Line 48 is connected to a source of liquid fuel and lines 50 and 4 are run to a position adjacent the steam injection boiler. For the final tie in, the original gas burner may, if necessary, be adapted or replaced to provide an appropriate burner 16*a* for handling liquid fuel and lines 50 and 4 are connected while all other work associated with the fired heater may be completed without any interference to the operating boiler. The lines can be connected to the steam boiler in any way, as by fixed connection such as welding or by releasable connection such as by quick-release fittings, flanges, etc.

If desired, installation of the conversion unit can include various other procedures to modify operation of the converted boiler or to meet environmental, safety, etc. requirements. For example, since most conventional boilers have a water pre-heater (economizer) coil (item 21 in FIG. 1) below the exhaust stack and since most of these coils have finned surfaces, these coils can be de-finned or replaced with studded tubes to facilitate liquid fuel firing. As another example, in respect of gaseous fuel fired boilers that are lined with ceramic fiber, the ceramic fiber could be covered with stainless steel liners to facilitate liquid oil firing (i.e. in case of oil leakage or spillage, to avoid any soaking of oil into the ceramic fiber). In addition, or alternately, boiler components may have to be treated to address corrosion issues, such as those relating to the deposit of vanadium pentoxide, discussed herein-below.

Use of the conversion unit to permit liquid fuel firing in a steam injection boiler is best understood by reference to a steam generation apparatus including a fired heater and a steam injection boiler. Thus, reference is made to FIG. 3, which shows schematically such an apparatus.

Figure 3:
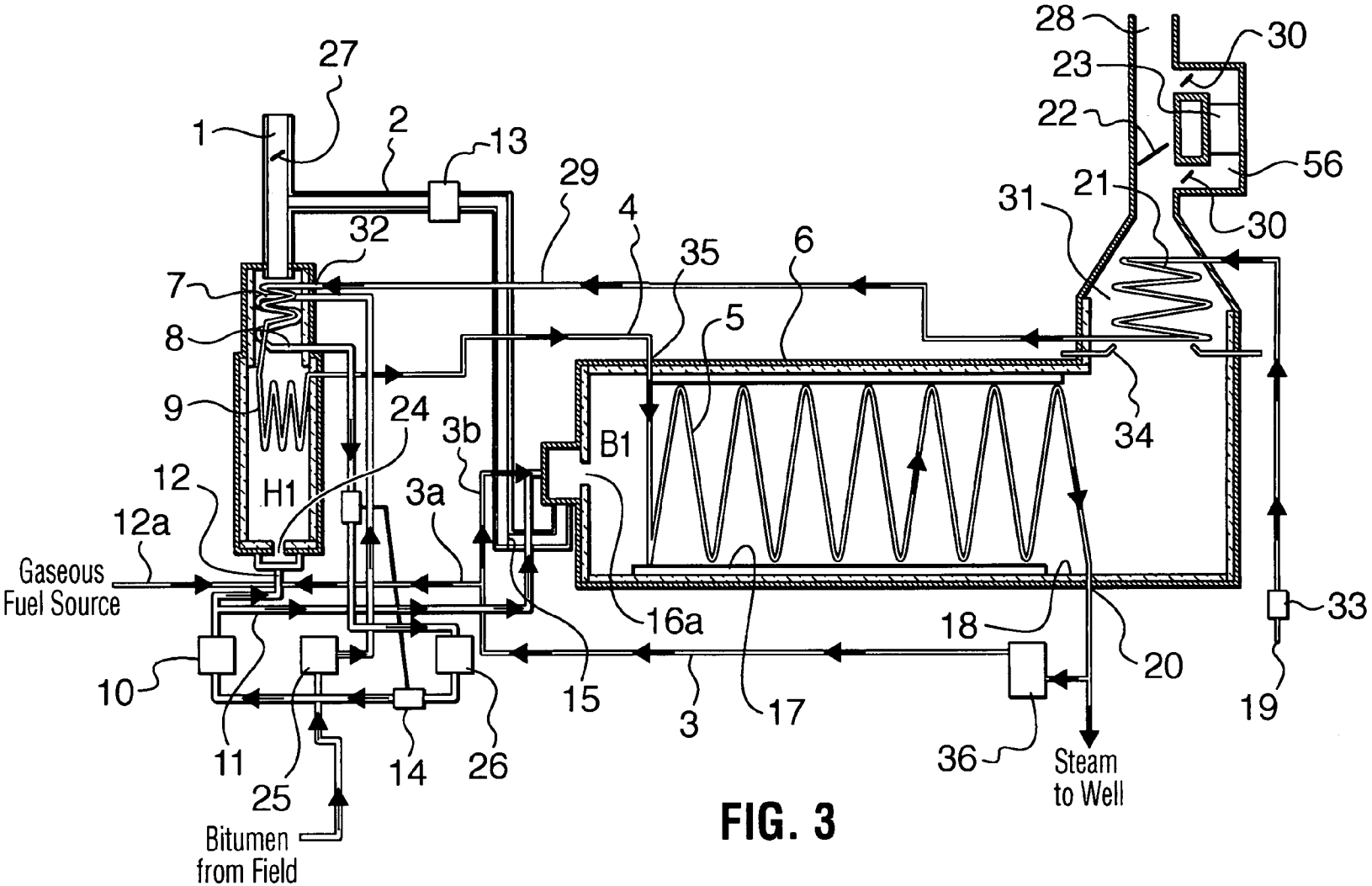
FIG. 3 is a schematic drawing of a steam generation apparatus according to the present invention.

FIG. 3 schematically illustrates a steam generation apparatus including a steam injection boiler B1 that has been converted, by installation of a conversion unit 44, to be capable of firing liquid fuel, such as heavy oil and, in one embodiment, bitumen.

Conversion unit 44 may be substantially as described in FIG. 2. Line 29 extends to provide passage of water from boiler preheat coil 21 to inlet 32 of fired heater H1. Line 4 is connected to inlet 35 of boiler steam coil 5. Boiler burner 16*a* is operable to handle at least a liquid fuel source. Line 50 is connected to burner 16*a*. Atomizing steam lines 3, 3*a* and 3*b* are connected between the boiler steam output lines and the burners 16*a* and 24. It may be useful to incorporate a steam water separator 36 to isolate the steam from the steam water mixture for use as atomizing steam.

In this illustrated embodiment, rather than mounting a scrubber in exhaust stack 1, a duct 2 extends between heater exhaust stack 1 and the boiler combustion chamber and exhaust stack 1 has mounted therein a damper 27 to control whether combustion gases continue to outlet through exhaust stack or are diverted through duct 2. Flue gas circulation through the duct may be driven by fan 13. Expansion joints, such as joint 15, can be provided in the duct.

Boiler B1 may be modified slightly to handle liquid fuel combustion. For example, burner 16*a* is selected to be liquid fuel compatible and includes a steam injection line 3*b* for fuel atomization. Boiler B1 accepts outlet of duct 2, which most conveniently for exhaust product handling, opens adjacent the burner end of the combustion chamber. Soot blowers 34 may be mounted to address the accumulation of solids. Exhaust stack 28 has mounted thereon a scrubber 23 for handling flue gases generated from burning bitumen. To reserve scrubber operation for only times when it is needed, scrubber 23 may be mounted in a bypass duct 56 on exhaust stack and a plurality of dampers 22 and 30 may be mounted to control direction of flue gas flow.

The invention permits a gas fired steam injection boiler to be converted and retrofitted with minimal interference to its operation. Most of the modifications may be carried out while the steam injection boiler continues in operation with little downtime required to finalize the conversion.

In use, start up procedures will vary depending on the embodiments of the heater and the boiler and the on site conditions. For example, the start-up procedure will vary depending on whether the steam generation apparatus is being used on an already producing or on a new well. In particular, since it is desirable to use bitumen as it is produced, the heater/boiler may have to be fired with an alternate fuel source to begin steam generation for driving bitumen production before firing on bitumen can be initiated.

Startup of auxiliary heater H1 is achieved by initially firing gas or liquid petroleum gas. Heater H1 may be operable and controllable separately from boiler B1. In one method, once the operating condition for the fired heater H1 is stabilized, bitumen flow through coil 8 may be initiated and a suitable bitumen temperature (i.e. as the fuel source, for example, for firing the fired heater H1 and the boiler B1) may be achieved. Burners 24 and 16*a* may then be fired up using bitumen as fuel. The bitumen can be from any source. However, since the steam generation apparatus is usually on site of a production facility, the bitumen may advantageously be from production. It is useful to use the bitumen substantially directly as it is produced, such that it retains latent heat of production and thereby has reduced viscosity over bitumen which has been allowed to cool or requires reheating just to be pumpable.

Water, which may be treated, enters the apparatus through line 19 and is pumped to the required pressure by the boiler feed pump 33. The high pressure water enters the steam injection boiler B1 convection zone primary preheater coils 21. The preheated water then crosses over to the auxiliary heater H1 convection zone via line 29 and enters the fired heater H1 at the hot water inlet 32 where it enters the secondary water preheat coil 7. The heated water from the preheat coil 7 is fed to the radiant zone steam water coil 9 where it is heated to meet desired inlet conditions at the boiler (B1 inlet at 5). The steam water then passes through boiler coil 5 and a steam water mixture at the desired conditions (i.e. 80% quality steam or other desired quality steam) emerges from the boiler B1 at outlet 20 for injection into the oil seams, as necessary. Since liquid fuel firing may generate fewer BTU's in the boiler, supplemental water heating in heater H1 may facilitate generation of a high quality steam. Heater H1 firing can be modulated to achieve a desired quality of steam at outlet 33.

A slip stream of steam can be diverted via lines 3, 3*a* and 3*b* to the burners 16*a*, 24 for atomization of bitumen.

Bitumen enters the system at the bitumen storage tank 25 and is pumped by pump 14 into the auxiliary fired heater H1 convection box. Once heated by passage through coil 8, the heated bitumen returns to the bitumen expansion tank 26 and, in turn, is pumped into the fuel handling system 10. The heated bitumen is then fed via heated lines 11 and 12 to the burners 24 and 16*a* for the heater H1 and the boiler B1, respectively. The bitumen feed to both of these burners 24 and 16*a* is atomized into the fireboxes using steam from lines 3*a*, 3*b*.

At startup, combustion by-products from auxiliary fired heater H1, which are generated from combustion of gaseous fuel such as petroleum, natural gas or liquid petroleum, can be vented to the atmosphere via the auxiliary heater stack 1. Once both units B1 and H1 are operational and burning bitumen, the flue gases should be scrubbed. Thus, in the illustrated embodiment, flue gases from the fired heater H1 are redirected to the boiler B1 by closing the damper 27 and starting up the recirculation fan 13 located on the flue gas recirculation duct 2.

The combustion by-products from the burning of gaseous fuel in heater H1 can be vented to the atmosphere via exhaust stack 1. For example, during startup it may be desirable to use gaseous fuel in the heater, in such case damper 27 may be open. During this start-up procedure, all exhaust products can be vented to atmosphere via stack 1, with the damper open and fan 13 out of service. When the bitumen has been heated to the required firing temperature, bitumen combustion can be commenced in heater H1. Once steady state conditions are established in heater H1 and all pre-start conditions are satisfied with boiler B1, burner 16*a* may be fired up. Dampers 30 may be closed and damper 22 open and exhaust products are vented to atmosphere via stack 28. Upon achieving a steady state condition in boiler B1, fan 13 will be brought into service while damper 27 is slowly closed and all combustion products are introduced to boiler B1 via duct 2. Once steady state conditions are achieved in both the heater and the boiler, then dampers 30 will be opened and damper 22 will be closed.

Once the steam generation apparatus has been successfully started up, all emission reduction treatment means can be activated. Sulfer dioxide ($SO_2$) may be treated at the by-pass scrubber 23 using technologies such as Sulfire™, lime or amine systems. Metals, ash, and other components can be collected, stabilized and disposed of at suitable landfill sites in accordance with applicable legislation, guidelines, accepted practice or as otherwise permitted by applicable authorities. By connecting the fired heater exhaust in series with the original steam generator, the combustion products are directed into the original steam generator for effective NOx reduction/mitigation and only one scrubber is required.

The conversion unit permits the boiler to be fired with bitumen (or other liquid fuel) and to generate necessary qualities and quantities of steam, while the bitumen flame in the boiler combustion chamber adheres to required clearances between the flame and the tube surfaces and refractory lining. This is done by shaping the bitumen flame to suit the enclosure, with an appropriate assessment made to determine the firing rate that can be safely accommodated. Any shortfall in steam generation arising from the lower firing rate of bitumen is recovered/generated in the fired heater. If necessary, the design can readily permit conversion back to gas firing by use of dual fuel burners or by replacement of the liquid fuel burner. Where higher steam production rates are desired, gas firing could be used in both the fired heater and the boiler. This could be achieved by using bitumen heating coils 8 with suitable metallurgy, for example, a 316 stainless steel or equivalent, that would allow heater operation while coil 8 is dry.

The combustion in the fired heater can be controlled to control steam quality and throughput. This control can be achieved by adjustment of the firing rate of the fired heater such as, for example, by adjustments of the firing rate at burner 24. For example, the firing rate of the fired heater can be adjusted to select for steam quality at inlet 35 and therefore steam quality at outlet 20. Larger BTU input in the heater results in greater quality and/or quantity steam production. For example, a higher quality steam, of greater than 80%, can be produced, with consideration to water coil fouling due to water deposits. It may be easier to control the heater's firing rate than the boiler's firing rate, since the heater's combustion chamber can be formed to accommodate various size flames. Generally, it is desirable to operate the boiler at a maximum firing rate and to control the heater firing rate to achieve finer control over steam quality and quantity. Also, the additional water heating capability of the heater is such that the steam production losses due to use for bitumen atomization can be made up by producing extra steam. Since the production of bitumen from in situ production varies proportionally with the rate of steam injection, extra steam production can be supplied for downhole injection to drive increased bitumen production. For example, the heating capability of the heater is such that the production losses due to bitumen use for steam generation firing can be made up by extra production of steam. This extra steam production may be used to drive increased bitumen production, such that after the boiler/heater fuel requirements are met, the desirable production rates from the site are maintained.

It is also possible to use one heater to serve two or more boilers. Depending on the size of the boilers, for example, it is possible to serve two steam generating boilers, of, for example, 80,000 kg/hour capacity, with one fired heater.

The burning of bitumen may require modifications in the boiler to address corrosion issues of internal parts. Bitumen contains various metals, such as vanadium and chromium. As bitumen combusts, vanadium deposits may form along convection tube surfaces in the form of vanadium pentoxide V2O5, which apart from being highly corrosive to chrome molybdenum tube supports, is equally effective in the conversion of sulfur dioxide SO2 to sulfur trioxide SO3, an even less desirable emission by-product of combustion. Tube supports may be stabilized by applying suitable metal sprays, while successful treatment of SO2 prior to its contact with vanadium pentoxide will help reduce the formation of SO3. The use of bare tubes and suitable soot blowers in the boiler and the heater convection sections may improve the life expectancy of these convection coils. Ash containing metals inherent to bitumen, such as chromium, et al, could be stabilized and disposed of in such manner(s) permitted by law. The convection tube surfaces in both the heater and the boiler could be washed periodically to remove any deposits.

While the foregoing has referred to conversion of steam generators, it is to be understood that the invention is also applicable to the construction of new steam generation facilities. For example, it will be appreciated that the foregoing systems for supplemental heating, liquid fuel handling and liquid fuel firing of a boiler can be applied to a new boiler installation. Due to the logistical and economic problems of producing boilers designed specifically for burning liquid fuels, it may be desirable to use a boiler sized for gaseous fuel burning installed with a fired heater, for example in substantially the configuration of FIG. 3. When manufacturing a new steam injection boiler intended for liquid fuel burning, consideration can, at the outset, be given to facilitating use of this fuel. For example, any new boilers can include a castable refractory lining, which is considered standard for liquid fuel firing, rather than fibrous refractories. As another example, the boiler can be entirely designed to operate with bitumen, rather than using a dual fuel burner. This presents significant cost advantages through the elimination of the need to install gas pipelines to transport gas to the operating area of the steam generation apparatus. In this regard, initial firing of the heater during initial startup may be with propane or another on-site fuel source.

Figure 4:
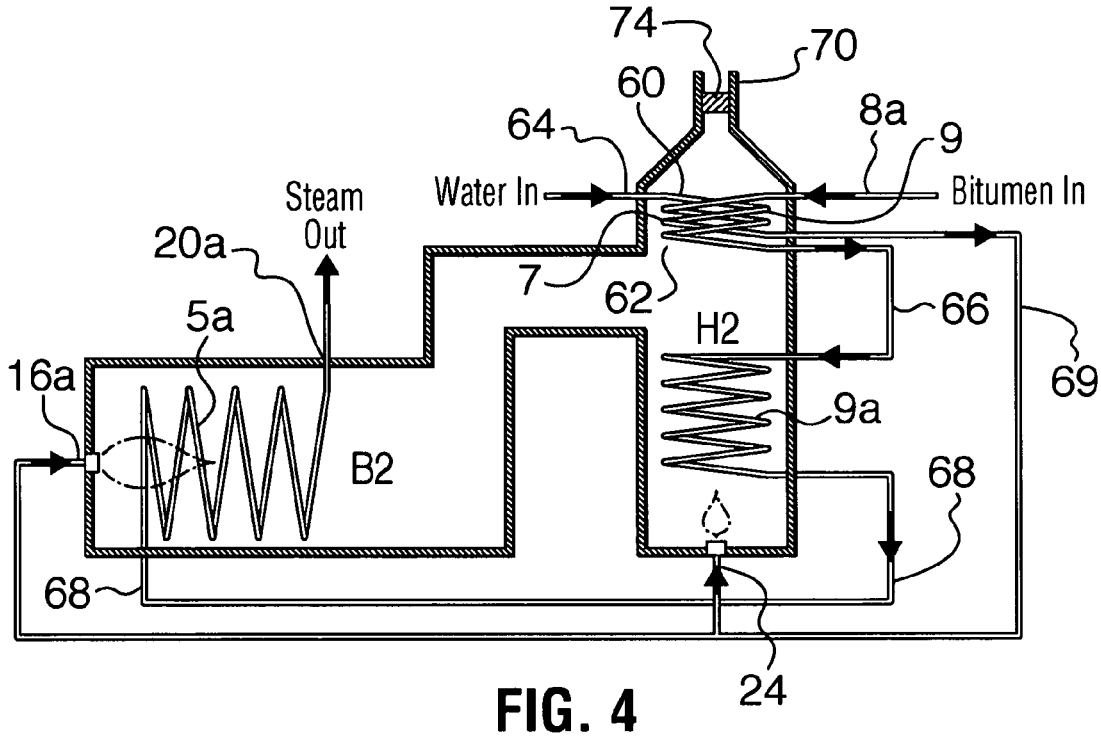
FIG. 4 is a schematic drawing of another steam generation apparatus according to the present invention.

As an example, referring to FIG. 4, another steam generation apparatus is shown, which has been built for the purpose of burning liquid fuel. The boiler B2 and heater H2 are more integrated than in FIG. 3. In particular, the apparatus has two radiant zone coils: a boiler coil 5*a* and a heater coil 9*a*, but only one convection zone coil 60 in a convection area 62 merged between the two units B2, H2. Water is introduced at inlet 64 passes through coils 60 and then passes through tube 66 to coils 9*a* where it is preheated to a final selected temperature for passage, via tube 68, to coils 5*a* of the boiler wherein steam is generated and outlet at 20*a*.

Convection area 62 also includes a fuel tube 8*a*, which heats fuel to be provided through tubes 69 to both the heater burner 24 and the boiler burner 16*a*.

The apparatus includes one exhaust stack 70 including a scrubber 74 mounted therein. Stack 70 accepts flue gas from both heater H2 and boiler B2.

In another embodiment, the steam apparatus can be formed such that the radiant zone of the heater is sufficient to preheat the water without requiring passage through a convection zone. However, such an embodiment may be considered wasteful as considerable heat may be lost without recovery from the combustion gases.

Figure 5:
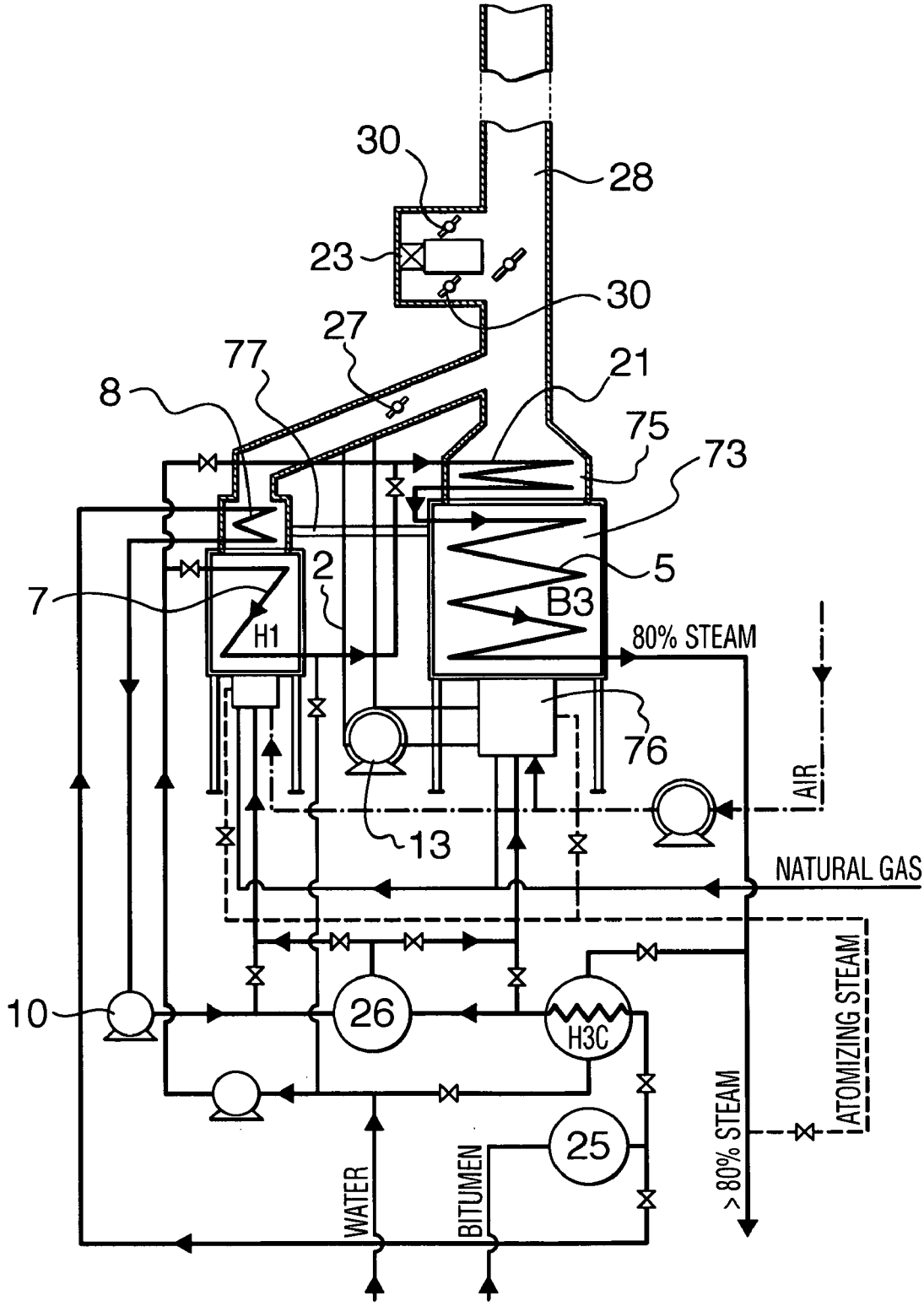
FIG. 5 is a schematic drawing of another steam generation apparatus according to the present invention.

Referring to FIG. 5, another steam generation apparatus is shown that can be used to produce steam by firing liquid fuel. This apparatus may include a boiler B3 built with the intention to fire liquid fuel. Boiler B3 is formed with an upright cylindrical outer wall forming an inner combustion chamber 73 and a convection zone 75. Water/steam coils are mounted in the boiler including both preheat coils 21 in the convection zone and radiant coils 5 adjacent a burner 76. In the illustrated embodiment, coils 21 feed directly into radiant coils 5. Burner 76 is positioned in the lower regions of the combustion chamber. Burner 76 may include a plurality of fuel nozzles, if desired. Such nozzles may be individually operable to control the flame characteristics. The fuel nozzles, for example, may be arranged in concentric or spaced arrangements to provide for selection of the base diameter of the flame and, therefore, the degree to which it impinges on coils 5.

Boiler B3 can be formed with consideration to the envelope, flame form and energy of a liquid fuel generated flame to accommodate it and utilize the energy generated therefrom. An upright boiler may provide certain advantages over a horizontal boiler, for example, the configuration may be easier to construct, transport and install, possibly with respect to size, handling and regulations. In one embodiment, for example, the boiler can be constructed and transported in longitudinal, fully lined leaf sections. As a further example, the upright configuration may offer enhanced natural draft operation in the event of a power loss, fan breakdown, etc. Furthermore, the upright boiler reduces the footprint size for better use of space and to reduce land costs.

The apparatus further includes a heater H1 that is substantially similar to those described hereinbefore. Heater H1 may operate to condition the liquid fuel and/or assist with steam generation. In the illustrated embodiment, the heater includes a liquid fuel coil 8 in a lower temperature region of the heater and a water preheat coil 7 in a higher temperature region of the heater. Water preheat coil 7 feeds water into coil 21.

Since a problem with steam generation can be quite costly for a bitumen operation, the apparatus in this embodiment includes a back up liquid fuel heater H3C. Heater H3C may be operated in various ways, as in the illustrated embodiment, by steam heat exchange. Should heater H1 fail or require to be shut down, fuel conditioning may continue through heater H3C. Similarly, should boiler B3 fail or require a shut down some steam generation can continue through heater H1. This, of course, is true for the apparatus of FIGS. 3 and 4, as well.

Due to their upright configuration, common towers, ladders and platforms 77 may be installed between the heater and the boiler. A plurality of heaters and boilers can be provided. In one embodiment, for example, one fired heater can be used and perhaps positioned centrally to supply conditioned fuel to a plurality of boilers.

Figure 6:
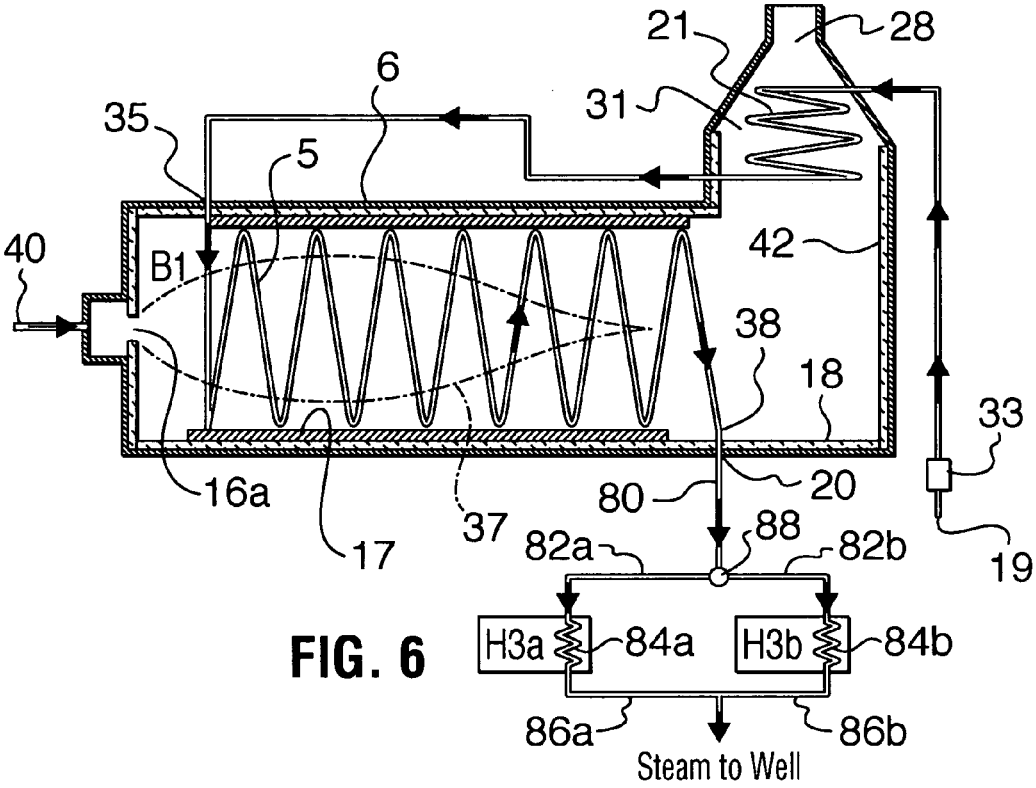
FIG. 6 is a schematic drawing of another steam generation apparatus according to the present invention.

As mentioned previously, steam generation may cause fouling in water/steam coils. Since fouling may require costly shut downs or replacement and fouling increases with increased steam quality, many operations use a cost/benefit analysis to balance the steam quality against resultant fouling. Many operations have settled on a steam quality of about 80% since this generates steam with good heat energy without rapid fouling of the boiler. Referring to FIG. 6, another steam generation apparatus is shown that can be used, if desired, to consistently produce high quality steam of, for example, greater than 80% consistently while minimizing concern as to steam generation shut down for defouling of water tubes, which is a significant deterrent to generation of steam at greater than 80% quality and without the need to make significant investments in pre-boiler water treatment. The apparatus includes a pair of step-up heaters H3*a* and H3*b* in association with a boiler B1. Heaters H3*a* and H3*b* are positioned in communication with an outlet 20 from coil 5 of boiler B1 to accept steam from the boiler and further heat the steam as it passes out of the boiler. The steam from the boiler can be, for example, at a maximum of about 80% and the step-up heaters can increase the percentage of steam per flow volume. As such, the boiler conditions can be selected to cause minimal fouling therein while a major portion of fouling occurs in heaters H3*a* and H3*b*. Heaters H3*a* and H3*b* can be positioned and selected to facilitate back up or alternating operation and defouling such that one or both of the heaters can be operated to heat the steam from the boiler until one heater, H3*a* for example, requires cleaning. At that point, the steam from the boiler can be diverted to the other heater, H3*b* in this example, which heater can operate, perhaps at increased BTU, to continue to heat the steam while the first heater H3*a* can be defouled. Thus, the operation of heaters H3*a* and H3*b* can be operated alternately in association with boiler B1 to produce very high quality steam while permitting defouling or replacement during continued steam production. In one embodiment, heaters H3*a*, H3*b* may be independent such that operation of one does not adversely effect chemical defouling of the other.

In the illustrated embodiment, steam from boiler B1 passes through outlet 20 into line 80. Heaters H3*a* and H3*b* are positioned separately and in parallel, each being a once through system and each having a supply line 82*a*, 82*b* in communication with line 80, steam generation coils 84*a*, 84*b* and outlet lines 86*a*, 86*b*. A valve 88 controls steam flow from line 80 such that steam can be selected to flow into both or either heaters H3*a* or H3*b*. Temperature, pressure or other conditions can be selected to foul up the coils in heaters H3*a*, H3*b*, while generating steam of selected characteristics. Valve 88 may control steam flow so that only one heater may be in operation while the other heater is isolated from the steam. Thus, when necessary, one of the heaters, for example H3*a*, can be chemically cleaned while the other heater, H3*b*, remains in operation to generate high quality steam. Once the coils of heater H3*a* have been cleaned that heater can immediately or whenever desired be returned to operation by actuating valve 88 and firing up the heater. Heater H3*a* can be operated either while H3*b* continues operation or while H3*b* is taken off line, for example to clean its coils. When the coils of heater H3*b* have fouled to the extent that they require cleaning, heater valve 88 can be actuated to take heater H3*b* off line, by directing flow to line 82*a*, coils 84*a*, and line 86*a*. This permits heater H3*b* to be cleaned while the generation of high quality steam is not interrupted.

While the apparatus of FIG. 6 has been described with respect to producing high quality steam of for example greater than 80%, it is to be understood that the boiler B1 and heaters H2*a*, H2*b* may be operated to generate high quality steam and/or to preferentially cause fouling in the heaters rather than in the boiler even with lower steam concentrations at or below about 80%. For example, where it is desired to extend the life span of the boiler, with or without the desire to generate high steam concentrations, the steam may be heated to a selected degree in the boiler, such degree being selected to minimize fouling and other stresses in the boiler. The remaining heat can be applied in heaters H3*a*, H3*b* to bring the steam up to a required quality. A cost benefit approach can be taken, wherein the boiler lifespan is compared against operation of the heaters.

Parallel step-up heaters can be repositioned to preheat and defoul water prior to flow into the boiler, if desired.

Coils 84*a*, 84*b* may be selected and configured to withstand the rigours of enhanced foul up and more regular cleaning. Furthermore since continued fouled operation and cleaning may reduce the expected life of a heater, the heaters may be formed and constructed of relatively less expensive materials, methods and controls, for example using carbon steel for water coils rather than the more expensive alloys. As such, the heaters may be less expensive than boiler B1 and, thereby, more expendable and more cost effectively replaced. Such an arrangement of step up heaters may be less expensive over time than other forms of water treatment.

Figure 7:
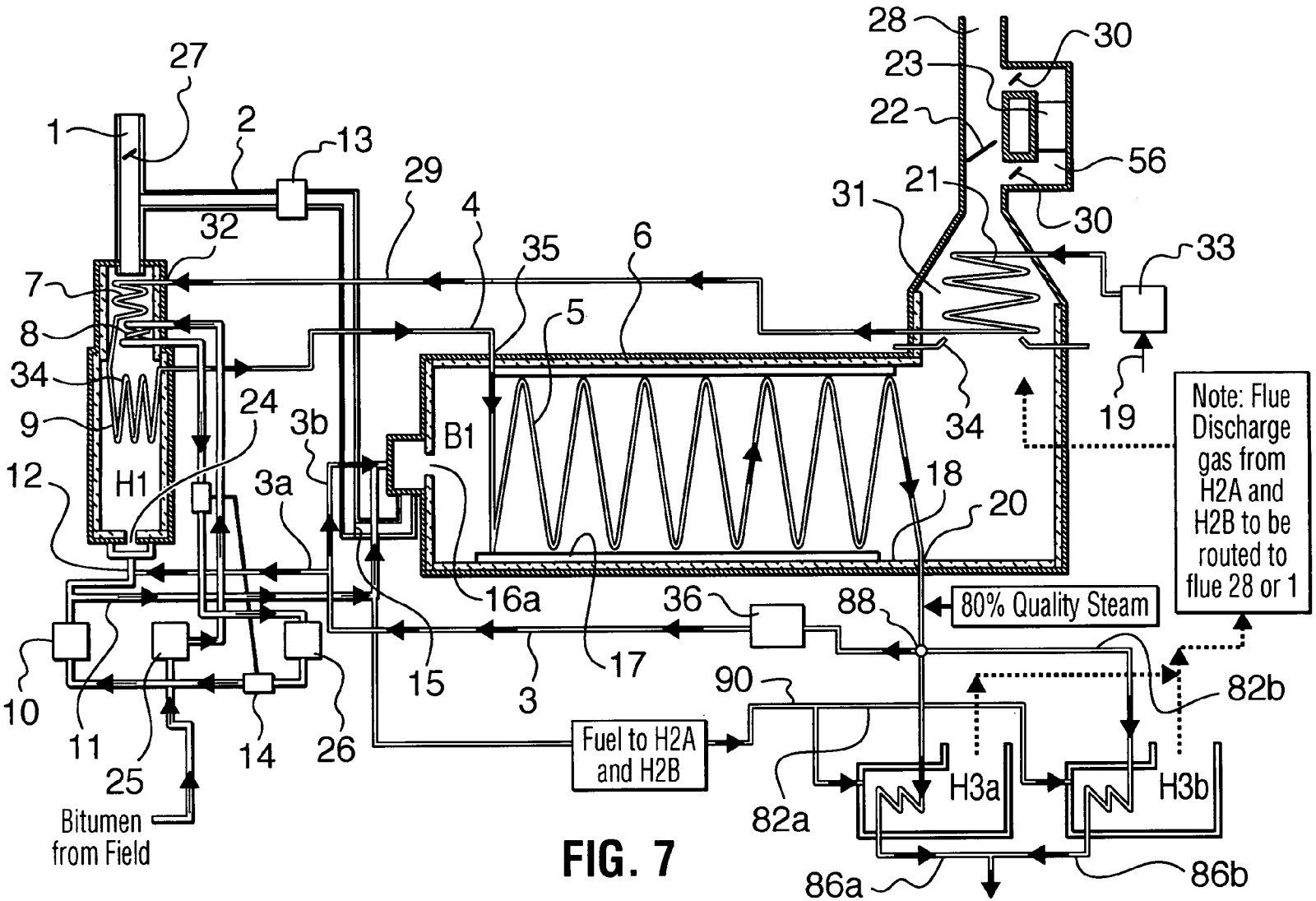
FIG. 7 is a schematic drawing of another steam generation apparatus according to the present invention.

It is to be noted that the parallel step up heaters can be used with a gaseous fuel or a liquid fuel fired boiler. In addition, the heaters H3*a*, H3*b* can be gaseous fuel fired or liquid fuel fired. Of course, if the heaters are used with a liquid fuel fired boiler, it is useful to also have the heaters fired by liquid fuel. For example, with reference to FIG. 7, boiler B1 and heaters H3*a*, H3*b* are fired by liquid fuel through lines 90. Flue discharge from heaters H3*a*, H3*b* are routed via ducts 92 to the boiler flue exhaust or to the fired preheater H1 flue exhaust. The parallel step up heaters can be used with any boiler configuration. For example, the heaters can be used with the any of the boilers of FIGS. 4, 5 or as shown in FIG. 7.

Although preferred embodiments of the present invention have been described in some detail hereinabove, those skilled in the art will recognise that various substitutions and modifications may be made to the invention without departing from the scope and spirit of the appended claims.

What is claimed is:

1. A steam generation apparatus comprising:

a steam injection boiler including a burner operable therein;

a fired heater including a heater burner;

a water tube circuit extending through the fired heater and the steam injection boiler, the tube selected to convey water in order to heat the water to generate steam;

a fuel tube extending through fired heater selected to convey liquid fuel in order to generate heated liquid fuel; and a tube for conveying the heated liquid fuel to support the firing of the steam injection boiler.

2. The steam generation apparatus of claim 1 wherein the water tube circuit passes first through the fired heater and then through the steam injection boiler.

3. The steam generation apparatus of claim 1, the heater further including a convection zone and a radiant zone and wherein the water tube circuit passes through the fired heater convection zone and the fired heater radiant zone.

4. The steam generation apparatus of claim 1, the steam injection boiler further including a convection zone and a radiant zone and wherein the water tube circuit passes, in series, through the boiler convection zone, the fired heater and the boiler radiant zone.

5. The steam generation apparatus of claim 1 wherein the heater burner operates on gaseous fuel.

6. The steam generation apparatus of claim 1 wherein the heater burner is capable of operating on both gaseous fuel and liquid fuel.

7. The steam generation apparatus of claim 6 further comprising a tube for conveying the heated liquid fuel to support the firing of the fired heater.

8. The steam generation apparatus of claim 1 the fired heater further including a convection zone and wherein the fuel tube passes through the fired heater convection zone in order to generate heated liquid fuel.

9. The steam generation apparatus of claim 8, wherein the water tube circuit passes through the fired heater convection zone and the fuel tube is shielded by the water tube circuit to reduce coking in fuel tube.

10. The steam generation apparatus of claim 1, the steam injection boiler further including an exhaust stack and a scrubber operationally mounted in the exhaust stack.

11. The steam generation apparatus of claim 1 wherein the heater burner is capable of operating on liquid fuel and the fired heater being in communication with an exhaust stack including a scrubber operationally mounted therein.

12. The steam generation apparatus of claim 1 further comprising ducting between the fired heater and the steam injection boiler, an exhaust stack and a scrubber operationally mounted in the exhaust stack and wherein the flue gases generated by both the heater and the steam injection boiler are passed through the exhaust stack.

13. The steam generation apparatus of claim 1 wherein the firing rate of the heater burner can be adjusted to adjust steam quality and/or quantity generated by the steam generation apparatus.

14. A steam injection boiler conversion unit for converting a steam injection boiler from gaseous fuel firing to be capable of liquid fuel firing, the steam injection boiler including a burner operable therein and a boiler tube extending therethrough, the steam injection boiler conversion unit comprising:

a fired heater including a heater burner;

a water tube extending through the heater, the water tube selected to convey water in order to heat the water and the water tube being connectable into fluid flow communication with the boiler tube such that, when connected, fluid passing from the water tube can pass into the boiler tube;

a fuel tube extending through the heater, the fuel tube selected to convey liquid fuel in order to generate heated liquid fuel; and, a line connectable into fluid flow communication with the burner of the boiler for supplying the heated liquid fuel to support the firing of the boiler burner, when the conduit is connected to the boiler burner.

15. The steam injection boiler conversion unit of claim 14, wherein the fired heater is operable to heat the liquid fuel to a temperature suitable for firing the boiler burner.

16. The steam injection boiler conversion unit of claim 14, wherein the fired heater is operable to preheat the water and delivers it to the inlet of the steam injection boiler at a temperature that offsets the shortfall in heat liberation from a liquid fuel flame suitable for generation within the steam injection boiler.

17. The steam injection boiler conversion unit of claim 14, the heater further including a convection zone and a radiant zone and wherein the water tube passes through the fired heater convection zone and the fired heater radiant zone.

18. The steam injection boiler conversion unit of claim 14, the steam injection boiler further including a convection zone and a radiant zone and wherein the water tube receives water having already passed through the boiler convection zone.

19. The steam injection boiler conversion unit of claim 14 wherein the heater burner operates on gaseous fuel.

20. The steam injection boiler conversion unit of claim 14 wherein the heater burner is capable of operating on both gaseous fuel and liquid fuel.

21. The steam injection boiler conversion unit of claim 20 further comprising a tube for conveying the heated liquid fuel to support the firing of the fired heater.

22. The steam injection boiler conversion unit of claim 14 the fired heater further including a convection zone and wherein the fuel tube passes through the fired heater convection zone in order to generate heated liquid fuel.

23. The steam injection boiler conversion unit of claim 22, wherein the water tube circuit passes through the fired heater convection zone and the fuel tube is shielded by the water tube to reduce coking in the fuel tube.

24. The steam injection boiler conversion unit of claim 14 wherein the heater burner is capable of operating on liquid fuel and the fired heater being in communication with an exhaust stack including a scrubber operationally mounted therein.

25. The steam injection boiler conversion unit of claim 24 further including a duct connectable to the boiler for passing flue gases to the steam injection boiler.

26. A method for converting a steam injection boiler from gaseous fuel firing to be capable of liquid fuel firing, the steam injection boiler including a burner operable therein and a boiler tube extending therethrough, the method for converting comprising:

providing a fired heater including a heater burner, a water tube extending through the heater, the water tube selected to convey water in order to heat the water and a fuel tube extending through the heater, the fuel tube selected to convey liquid fuel in order to generate heated liquid fuel;

bringing the water tube in fluid flow communication with the boiler tube such that fluid passing from the water tube can pass into the boiler tube; and conveying the heated liquid fuel to the burner of the boiler to support the firing of the steam injection boiler.

27. The method of claim 26 further comprising replacing the burner of the steam injection boiler with a burner compatible with liquid fuel burning.

28. The method of claim 26, further comprising modifying the steam injection boiler to handle at least some of the emissions from liquid fuel combustion.

29. The method of claim 26, the steam injection boiler further including an exhaust stack and the method further comprising, installing in the exhaust stack a scrubber for handling at least some of the emissions from liquid fuel combustion.

30. The method of claim 26, wherein the steam injection boiler can continue to be operated until the step of bring the water tube into fluid communication with the boiler tube.

31. A method for generating steam, the method comprising:

providing a steam generation apparatus including a steam injection boiler having a burner operable therein;

a fired heater including a heater burner; a water tube circuit extending through the fired heater and the steam injection boiler, the water tube circuit selected to convey water in order to heat the water to generate steam; a fuel tube extending through the heater selected to convey liquid fuel in order to generate heated liquid fuel; and a line for conveying the heated liquid fuel to support the firing of the steam injection boiler;

firing the fired heater to heat a supply of liquid fuel passing through the fuel tube;

conveying the liquid fuel through the conduit to support firing of the steam injection boiler; and passing a flow of water through the water tube circuit such that steam is generated.

32. The method for generating steam of claim 31 wherein the liquid fuel is taken from in situ production.

33. The method for generating steam for in situ production of petroleum products of claim 32 wherein the liquid fuel is used while it retains latent heat from production.

34. The method for generating steam of claim 31 further comprising operating the fired heater on gaseous fuel initially and, thereafter, operating the fired heater with heated liquid fuel.

35. The method for generating steam of claim 31, the method further comprising adjusting steam quality generated by adjusting the firing rate of the fired heater.

* * * * *